United States Patent [19]

Overcash et al.

[11] Patent Number: 4,841,584

[45] Date of Patent: Jun. 27, 1989

[54] SHAMPOO LOUNGE CHAIR

[76] Inventors: Charalotta A. Overcash, 1714 W. "A" St., Kannapolis, N.C. 28081; George Spector, 233 Broadway, Rm. 3615, New York, N.Y. 10007

[21] Appl. No.: 891,141

[22] Filed: Jul. 31, 1986

[51] Int. Cl.[4] ..... A45D 19/08

[52] U.S. Cl. ..... 4/519

[58] Field of Search ..... 4/515–523; 16/286, 375; 132/9

[56] References Cited

U.S. PATENT DOCUMENTS

| | | | |
|---|---|---|---|
| 2,245,487 | 6/1941 | Machin | 16/286 X |
| 2,854,969 | 10/1958 | Nolan | 4/518 X |
| 2,854,970 | 10/1958 | Nolan | 4/517 X |
| 3,187,372 | 6/1965 | Parsons | 16/375 |
| 3,292,186 | 12/1966 | Turmenne et al. | 4/519 |
| 3,343,530 | 9/1967 | Solos et al. | 4/518 X |
| 3,521,647 | 7/1970 | Mercer | 4/519 X |
| 3,575,181 | 4/1971 | Rudd | 4/518 X |
| 3,752,399 | 8/1973 | Neale et al. | 4/518 X |

*Primary Examiner*—Charles E. Phillips

[57] ABSTRACT

A shampoo lounge chair is provided which combines a sink and an inclined chair into one complete unit. A spray cap adjustably fits onto the sink so that a person can sit back in the chair placing their head over the sink and under the spray cap to receive water and shampoo therefrom when washing the hair of the person.

2 Claims, 1 Drawing Sheet

SHAMPOO LOUNGE CHAIR

BACKGROUND OF THE INVENTION

The instant invention relates generally to beauty parlor equipment and more specifically it relates to a shampoo lounge chair.

Numerous beauty parlor equipment have been provided in prior art which are sinks and adjustable recliner chairs used to wash the hair of customers before their hair is cut and styled. While these units may be suitable for the particular purpose to which they address, they would not be as suitable for the purposes of the present invention as heretofore described.

SUMMARY OF THE INVENTION

A principle object of the present invention is to provide a shampoo lounge chair that will overcome the shortcomings of the prior art devices.

Another object is to provide a shampoo lounge chair that combines a sink and a inclined chair into one complete unit.

An additional object is to provide a shampoo lounge chair that includes a spray cap that adjustably fits onto the sink and over the head of the customer to spray water and shampoo therefrom.

A further object is to provide a shampoon lounge chair that is simple and easy to use.

A still further object is to provide a shampoo lounge chair that is economical in cost to manufacture.

Further objects of the invention will appear as the description proceeds.

To the accomplishment of the above and related objects, this invention may be embodied in the form illustrated in the accompany drawing, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
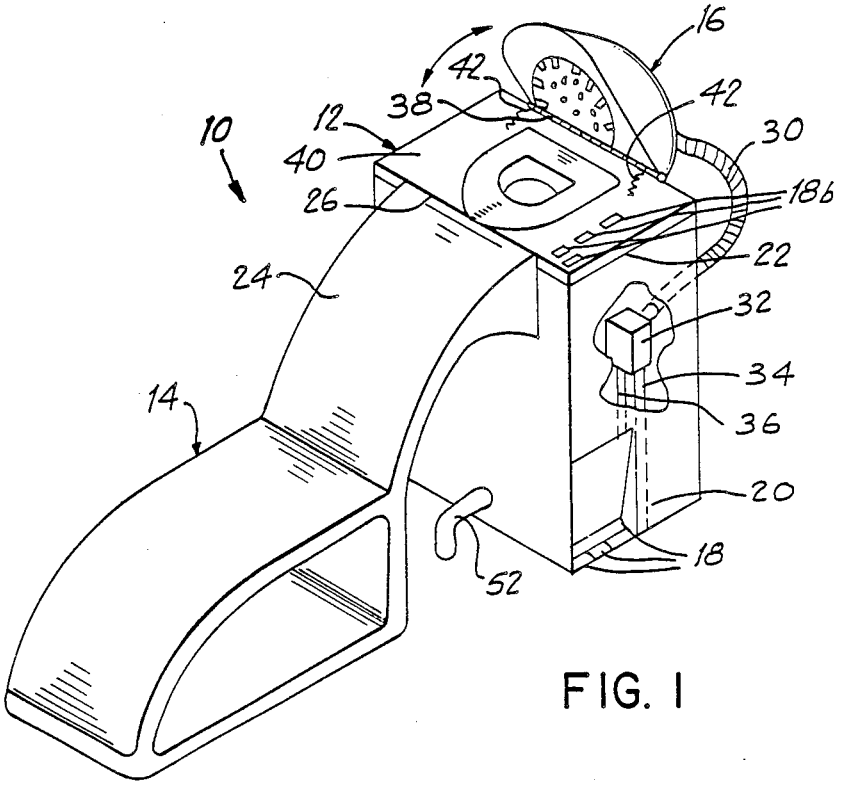
FIG. 1 is a perspective view of the invention.
Figure 2:
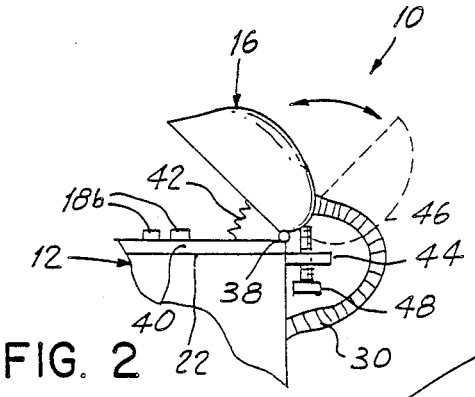
FIG. 2 is a partial side view showing an adjustment screw for the pivot spray cap.
Figure 3:
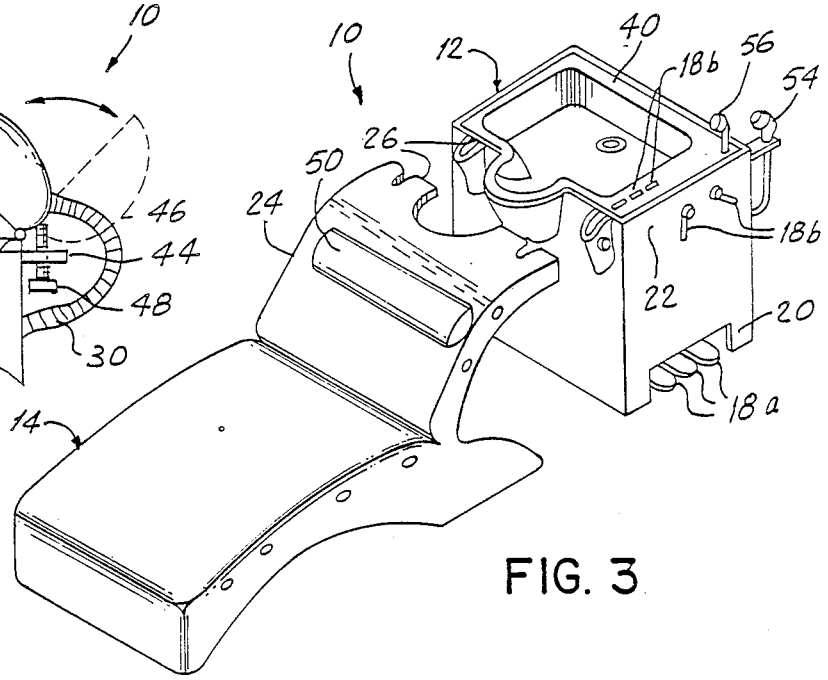
FIG. 3 is a perspective view showing another version of the shampoo chair lounge without the spray cap in place.

Turning now descriptively to the drawings, in which similar reference characters denote similar elements throughout the several views, FIGS. 1 to 3 illustrates a shampoo lounge chair 10 which basically consists of a sink unit 12, a chair 14 and a spray cap 16.

The sink unit 12 has a plurality of controls 18*a* and 18*b* for supplying hot water, cold water and shampoo therefrom by an operator (not shown). Some of the controls 18*a* of the sink unit 12 are positioned at lower portion 20 of the sink unit and controlled by feet of the operator. Some of the controls 18*b* of the sink unit 12 are positioned at upper portion 22 of the sink unit and controlled by hands of the operator.

The chair 14 has an inclined back rest 24 attachable to the sink unit 12 at 26 so that a person (not shown) can sit upon the chair 14 and place their head back over the sink unit. THe spray cap 16 has a plurality of spouts 28 fluidly connected via a hose 30, mixer valve 32 and hot and cold water pipes 34, 36 from the controls 18*a* and 18*b*. The spray cap 16 is adjustably affixed to the sink unit 12 to be positioned over the head of the person. The hot water, the cold water and the shampoo can eject from the spouts 28 at different intervals by the operator activating the controls 18*a* and 18*b* of the sink unit 12 to wash hair of the person.

The shampoo lounge chair 10 further contains a hinge 38 mounted to rear of the top portion 40 of the sink unit 12 so that the spray cap 16 can pivot thereon. A pair of springs 42 are affixed between the spray cap 16 and the top portion 40 of the sink unit 12 to bias the spray cap in an opened position as shown in dotted in FIG. 2. A flange 44 is provided which has a threaded hole 46 therein and extends rearwardly from the top portion 40 of the sink unit 12 adjacent the hinge 38. A bolt 48 is threaded into the threaded hole 46 of the flange 44 to engage with the spray cap 16 so as to adjust position of the spray cap 16.

As shown in FIG. 3 the chair 14 further includes a shoulder rest 50 affixed to the inclined back rest 24 to inhance comfort to the person when the hair is being washed.

An outlet drain 52 shown in FIG. 1, a hand rinse spray 54 and shampoo applicator 56 shown in FIG. 3 can also be adapted to the shampoo lounge chair 10.

While certain novel features of this invention have been shown and described and are pointed out in the annexed claims. It will be understood that various omissions, substitutions and changes in the forms and details of the device illustrated and in its operation can be made by those skilled in the art without departing from the spirit of the invention.

What is claimed is:

1. A shampoo lounge chair which comprises:

(a) a sink unit with a front side and a back side, having a plurality of controls for supplying hot water, cold water and shampoo, and a top portion with a sink therein;

(b) a chair having an inclined back rest attachable to said front side adjacent said sink so that a person can sit upon said chair and place their head back over said sink;

(c) a spray cap having a plurality of spouts fluidly connected to said controls, said spray cap adjustably affixed to said back side, adjacent said sink, to be positioned over a person's head so that hot water, cold water and said shampoo can be ejected from said spouts on the person's head at different intervals by said operator activating said controls of said sink unit to wash the hair of said person, in combination with means for adjusting the spray cap position; wherein said means comprise:

(d) a hinge mounted at the rear of said sink so that said spray cap can pivot thereon;

(e) a pair of springs affixed between said spray cap and said top portion of sink unit to bias said spray cap in an opened position;

(f) a flange having a threaded hole therein and extending rearwardly from said top portion of said sink unit adjacent said hinge; and (g) a bolt threaded into said threaded hole of said flange to engage with said spray cap so as to adjust the position of said spray cap.

2. A shampoo lounge chair as recited in claim 1, wherein said chair further includes a shoulder rest affixed to said inclined back rest to enhance comfort to said person when said hair is being washed.

* * * * *